US006412705B1

(12) United States Patent
Desai et al.

(10) Patent No.: US 6,412,705 B1
(45) Date of Patent: Jul. 2, 2002

(54) HYDRAULICALLY-ACTUATED FUEL INJECTOR HAVING FRONT END RATE SHAPING CAPABILITIES AND FUEL INJECTION SYSTEM USING SAME

(75) Inventors: Chetan J. Desai, Bloomington, IL (US); Xinshuang Nan, Bloomington, IN (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/566,714

(22) Filed: May 9, 2000

(51) Int. Cl.[7] ..... F02M 47/02

(52) U.S. Cl. ..... 239/88; 239/90; 239/95; 239/96; 239/124; 239/533.4; 123/446

(58) Field of Search ..... 239/88, 90–93, 239/95, 96, 533.4, 533.5, 533.8, 124; 123/446, 496, 506

(56) References Cited

U.S. PATENT DOCUMENTS 4,379,524 A 4/1983 Andrews
4,627,570 A 12/1986 Morell et al.
4,979,674 A 12/1990 Taira et al.
5,323,964 A 6/1994 Doszpoly et al.
5,333,786 A * 8/1994 Gant et al. ..... 239/90 X
5,492,098 A 2/1996 Hafner et al.
5,687,693 A * 11/1997 Chen et al. ..... 123/446
5,709,341 A * 1/1998 Graves ..... 239/533.4 X
5,730,104 A * 3/1998 Hafner ..... 123/446
5,826,562 A 10/1998 Chen et al.
5,887,790 A 3/1999 Flinn
5,894,992 A 4/1999 Liu et al.
5,899,389 A 5/1999 Pataki et al.
6,085,991 A * 7/2000 Sturman ..... 239/88
6,119,959 A * 9/2000 Smith, III et al. ..... 239/95 X
6,161,770 A * 12/2000 Sturman ..... 239/96 X

* cited by examiner

*Primary Examiner*—Steven J. Ganey
(74) *Attorney, Agent, or Firm*—Liell & McNeil; Michael B. McNeil

(57) ABSTRACT

A hydraulically actuated fuel injection system according to the present invention comprises at least one hydraulically actuated fuel injector that includes an injector body that defines a fuel pressurization chamber. A pumping element having a stepped top is movably mounted in a pumping bore defined by the injector body, wherein the pumping element defines at least one internal passageway. The pumping element is movable a distance between a first position and a second position. A spill passage defined by the injector body is open to the fuel pressurization chamber via the at least one internal passageway over a portion of the distance.

20 Claims, 6 Drawing Sheets

HYDRAULICALLY-ACTUATED FUEL INJECTOR HAVING FRONT END RATE SHAPING CAPABILITIES AND FUEL INJECTION SYSTEM USING SAME

TECHNICAL FIELD

The present invention relates generally to fuel injector rate shaping, and more particularly to front end rate shaping an injection event of a hydraulically actuated fuel injector utilizing a spill passage and a stepped pumping element.

1. Background Art

It has long been known in the art that injector performance can be increased, and undesirable emissions reduced, by controlling the mass flow rate of fuel injected into a combustion chamber during an injection event. It is also believed that the ability to front end rate shape an injection event can further reduce emissions and noise level while increasing injector performance. While a number of fuel injectors have been developed that have limited rate shaping capabilities, the ability to produce some front end rate shapes has not been possible. Therefore, a fuel injector having a broader range of front end rate shaping capabilities would allow engineers to further reduce undesirable emissions while increasing fuel injector performance.

The present invention is directed to overcoming one or more of the problems set forth above and to increasing the ability of hydraulically actuated fuel injector to produce different front end rate shapes.

2. Disclosure of the Invention

A hydraulically actuated fuel injection system according to the present invention comprises at least one hydraulically actuated fuel injector that includes an injector body that defines a fuel pressurization chamber. A pumping element having a stepped top is movably mounted in a pumping bore defined by the injector body, wherein the pumping element defines at least one internal passageway. The pumping element is movable a distance between a first position and a second position. A spill passage defined by the injector body is open to the fuel pressurization chamber via the at least one internal passageway over a portion of the distance.

BEST MODE OF CARRYING OUT THE INVENTION

Figure 1:
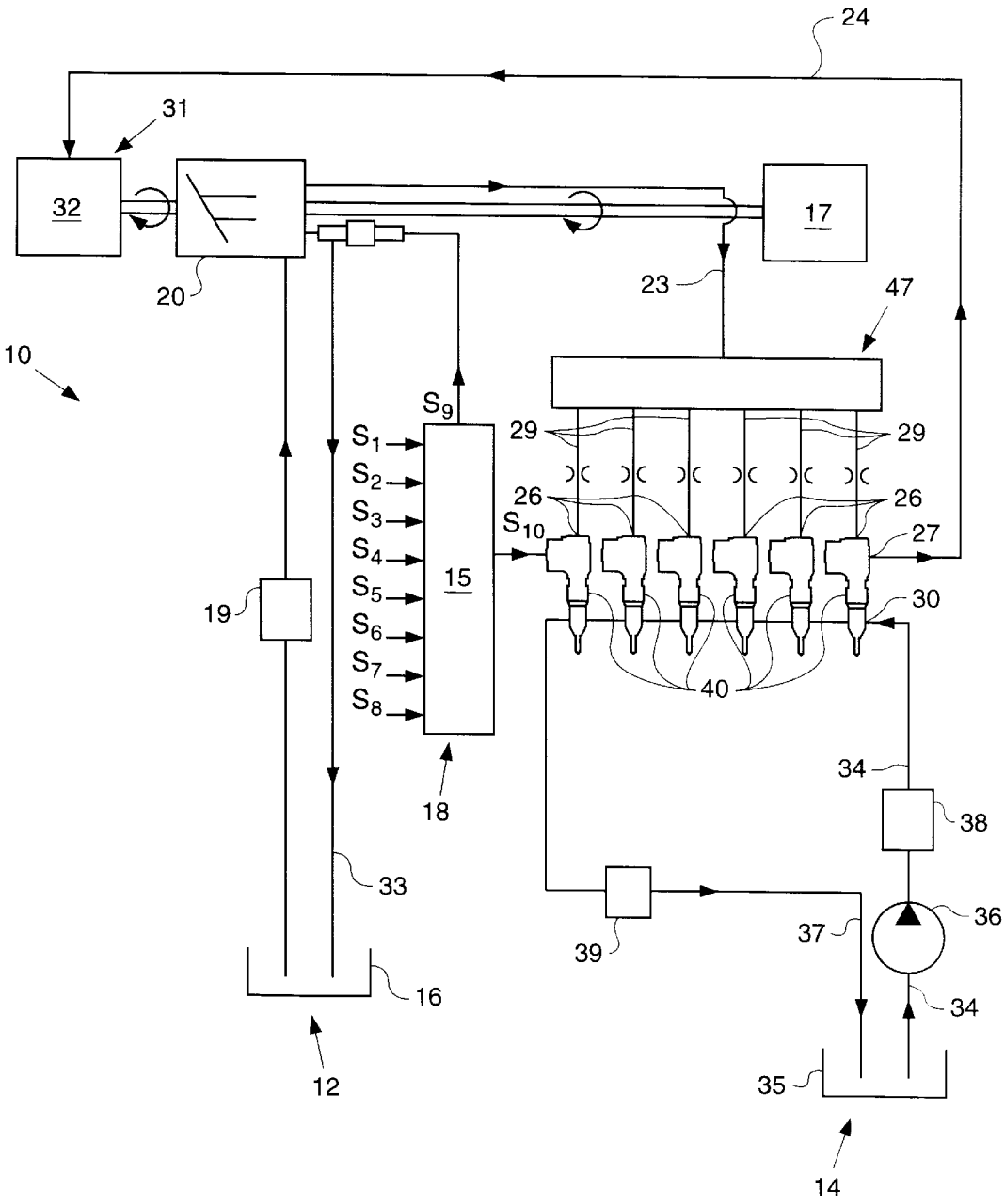
FIG. 1 is a schematic representation of a hydraulically-actuated fuel injection system according to the present invention.

Referring now to FIG. 1 there is shown a hydraulically-actuated fuel injection system 10 according to the present invention. Fuel injection system 10 includes at least one hydraulically actuated fuel injector 40, all of which are adapted to be positioned in a respective cylinder head bore of an engine. Fuel injection system 10 includes a source of low pressure actuation fluid 12 for supplying actuation fluid to each fuel injector 40 at a device inlet 26, and a source of fuel 14 for supplying fuel to each fuel injector 40 at a fuel inlet 30. Fuel injection system 10 also includes a means for recirculating actuation fluid 31, containing a hydraulic motor 32, which is capable of recovering hydraulic energy from oil exiting fuel injectors 40. A computer 18 is also included in fuel injection system 10 to control timing and duration of injection events. Computer 18 includes an electronic control module 15 which controls the timing and duration of injection events and pressure in a high pressure manifold 47. Based upon a variety of input parameters including temperature, throttle, engine load, etc. ($S_1$–$S_8$) electronic control module 15 can determine a desired injection timing and duration, and manifold pressure to produce some desired performance at the sensed operating conditions.

Low pressure actuation fluid source 12 preferably includes an oil pan 16, one or more actuation fluid filters 19, a high pressure pump 20 for generating high pressure in the oil, and at least one high pressure manifold 47. While the actuation fluid used in the present invention is preferably oil, it should be appreciated that any other suitable actuation fluid could instead be used. A pump outlet of high pressure pump 20 is arranged in fluid communication with high pressure manifold 47 via supply passageway 23. A branch passage 29 connects device inlet 26 of each fuel injector 40 to high pressure manifold 47. After performing work in each fuel injector 40, oil exits through device outlet 27 and is returned to oil pan 16 via recirculation line 33.

The source of fuel 14 preferably includes a fuel supply regulating valve 39 and a fuel circulation and return passage 37 arranged in fluid communication between the fuel injectors 40 and a source of fuel 35. Fuel is supplied to the fuel injectors 40 via a fuel supply passage 34 arranged in fluid communication between fuel source 35 and a fuel inlet 30 of each fuel injector 40. Fuel being supplied through the fuel supply passage 34 travels through a low pressure fuel transfer pump 36 and one or more fuel filters 38.

Figure 2:
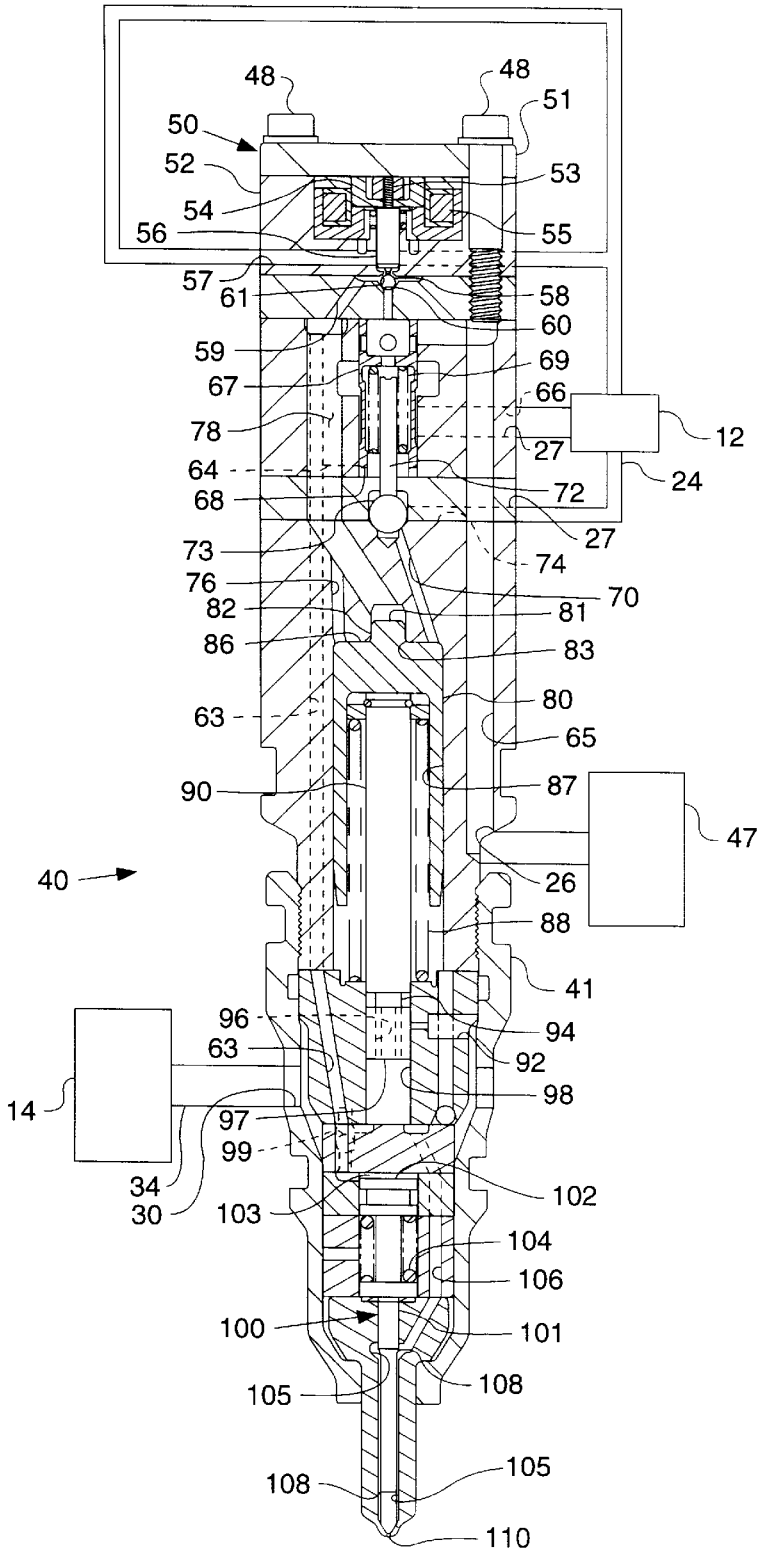
FIG. 2 is a sectioned side diagrammatic view of a hydraulically-actuated fuel injector according to the present invention for use with the fuel injection system of FIG. 1.
Figure 3:
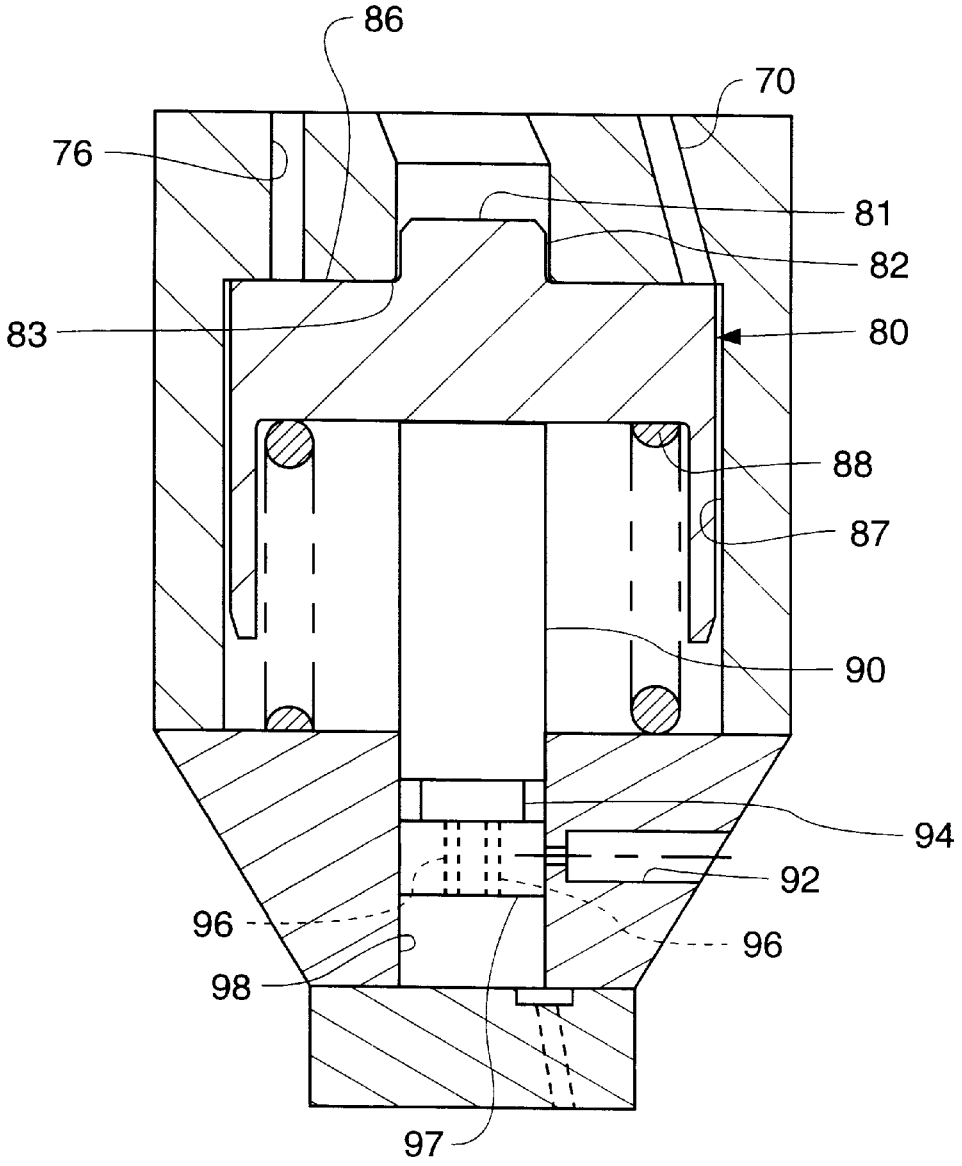
FIG. 3 is sectioned side view of the pumping element portion of the fuel injector of FIG. 2.

Referring now to FIGS. 2–3 there is shown a hydraulically-actuated fuel injector 40 according to the present invention. Fuel injector 40 includes an injector body 41 made up of various components that are attached to one another in a manner well known in the art and a substantial number of internal movable components positioned as they would be just prior to an injection event. Actuation fluid, which is preferably high pressure oil, can flow into a high pressure actuation fluid passage that is defined by injector body 41 via an actuation fluid inlet 26 and high pressure supply line 65 from high pressure manifold 47. At the end of an injection event, actuation fluid can flow out of a low pressure drain passage 57 that is defined by injector body 41 via an actuation fluid vent 27 into low pressure fluid reservoir 12. While a number of different fluids could be used as actuation fluid, the present invention preferably utilizes engine lubricating oil.

Fuel injector 40 is controlled in operation by a control valve 50 that includes an electrical actuator 51 which is preferably a solenoid 52, but could also be another suitable device such as a piezoelectric actuator. Control valve 50 is positioned in injector body 41 and attached by fasteners 48, which are preferably bolts but could be another suitable attachment device. Solenoid 52 includes a biasing spring 53, a coil 55, an armature 54 and a pin 56 that is operably coupled to a pilot valve member 58. Pilot valve member 58 has been illustrated as a ball valve member and is moveable within injector body 41 between a first position in which it closes a low pressure seat 61 and a second position in which it closes a high pressure seat 60. While pilot valve member 58 has been shown as a ball valve member, it should be appreciated that it could instead be a spool valve member or another suitable device, such as a poppet valve member. Injector body 41 also defines a control passage 59 that opens into a needle control passage 63 and a spool control passage 64. Prior to an injection event when solenoid 52 is de-energized, pilot valve member 58 is positioned in its first position to close low pressure seat 61, against the action of biasing spring 53. When pilot valve member 58 is in this position needle control passage 63 and spool control passage 64 are open to high pressure actuation fluid supply passage 65 via control passage 59 and blocked from fluid communication with low pressure passage 57. When solenoid 52 is energized, armature 53 pushes pin 56 downward to move pilot valve member 58 toward its second position to close high pressure seat 60, as shown. When pilot valve member 58 is in the second position, needle control passage 63 and spool control passage 64 are closed to high pressure actuation fluid supply passage 65 and open to low pressure passage 57 via control passage 59.

Needle control passage 63 is fluidly connected to a needle control chamber 103 while spool control passage 64 is in fluid communication with a hydraulic surface 68 of a control valve member 67. Control valve member 67, which is preferably a spool valve member, is positioned within injector body 41 and is movable between an upward position and a downward position. Control valve member 67 is biased toward its upward position by a biasing spring 69. When solenoid 52 is de-energized, and pilot valve member 58 is positioned to close low pressure seat 61, actuation fluid cavity 78 is open to low pressure drain 27. When solenoid 52 is energized and pilot valve member 58 is moved to close high pressure seat 60, a control valve hydraulic surface 68 becomes exposed to low pressure in drain 27, via spool control passage 64. This causes control valve member 67 to become hydraulically imbalanced and allows it to move downward against the action of biasing spring 69. When control valve member 67 is in its downward position, actuation fluid cavity 78 is open to high pressure fluid inlet 26 via radial openings 62 defined by control valve member 67.

Returning now to fuel injector 40, injector body 41 also g includes a reciprocating pumping element, illustrated as a piston 80 coupled to a plunger 90, which can move between an upward retracted position, as shown, and a downward advanced position. Piston 80 includes a stepped portion 82 and is biased toward its retracted position by a return spring 88. Piston 80 begins to advance due to the hydraulic pressure force exerted on a first hydraulic surface 81, defined by stepped portion 82, which is exposed to fluid pressure in actuation fluid cavity 78. A second hydraulic surface 86, defined by piston 80 is also fluidly connected to high pressure hydraulic fluid via a restricted side passage 76 The flow restriction causes a pressure drop so that second hydraulic surface 86 sees a relatively low pressure and provides an avenue to displace fluid into the volume or cavity above surface 86 so that piston 80 is not inhibited in its movement. With only first hydraulic surface 81 exposed to high pressure in actuation fluid cavity 78, piston 80 initially accelerates downward at a rate slower than it otherwise would if the fluid pressure were acting over the complete top surface of piston 80 Once hydraulic surface 81 advances past a shoulder 83, second hydraulic surface 86 becomes fully exposed to fluid pressure in actuation fluid cavity 78.

As illustrated in FIGS. 2–3, second hydraulic surface 86 and first hydraulic surface 81 compose the complete top surface of piston 80. Because the surface area of piston 80 that is exposed to fluid pressure in actuation fluid cavity 78 has been increased, piston 80 begins to accelerate more rapidly toward its advanced position. It should be appreciated that the greater the increase in surface area exposed to fluid pressure in actuation fluid cavity 78, the greater the increase in the speed of piston 80 and plunger 90 and the greater the maximum speed of piston 80 and plunger 90. In addition, the greater the height of stepped portion 82, the greater the length of time before second hydraulic surface 86 is exposed to fluid pressure in actuation fluid cavity 78. In other words, if the height of stepped portion 82 is relatively large, piston 80 and plunger 90 will not experience an increase in their movement rate toward their advanced positions due to this feature of the present invention until later in the injection event than if the height of stepped portion 82 is relatively small.

When piston 80 begins to advance, plunger 90 advances in a corresponding fashion. Therefore, at the beginning of an injection event, when only first hydraulic surface 81 is exposed to fluid pressure in actuation fluid cavity 78, plunger 90 advances at a relatively slow rate. However, this slower rate should still be sufficient to pressurize fuel, and maintain that pressure, above the valve opening pressure. Once first hydraulic surface 81 advances past shoulder 83, plunger 90 begins to advance more rapidly, corresponding to the more rapid movement of piston 80. Plunger 90 acts as the means for pressurizing fuel within a fuel pressurization chamber 98 that is connected to a fuel inlet 30 past a ball check valve 99. Fuel inlet 30 is connected to fuel source 35 via a fuel supply passage 34. When plunger 90 is returning to its upward position, fuel is drawn into fuel pressurization chamber 98 past check valve 99. During an injection event as plunger 90 moves toward its downward position, check valve 99 is closed and plunger 90 can act to compress fuel within fuel pressurization chamber 98. Fuel pressurization chamber 98 is fluidly connected to a nozzle outlet 110 via a nozzle supply passage 106.

As best illustrated in FIG. 3, plunger 90 preferably defines at least one internal passageway 96 that includes an annulus 94. In addition, injector body 41 defines a spill passage 92 that can fluidly connect fuel pressurization chamber 98 to a low pressure area via internal passageways 96 when annulus 94 is open to spill passage 92. When fuel pressurization chamber 98 is open to the low pressure area, the pressure acting on the top surface of piston 80 is greater that the pressure acting on plunger hydraulic surface 97. Therefore, plunger 90 and piston 80 move relatively quickly toward their advanced positions when annulus 94 is open to spill passage 92. Once annulus 94 is no longer open to spill passage 92, the advancing movement of plunger 90 and piston 80 slows. Note that while internal passageways 96 have been shown as being fluidly connected to spill passage 92 via annulus 94, an alternative means could be substituted. For instance, a radial passageway could be defined by plunger 90 to connect internal passageways 96 to spill passage 92. Therefore, it should be appreciated that the present invention contemplates any conventional means for fluidly connecting these passages.

It should be appreciated that the height of annulus 94 directly influences the duration of the drop in pressure in fuel pressurization chamber 98. For instance, if annulus 94 is relatively small, or =short, fuel pressurization chamber 98 will be open to spill passage 92 for a relatively short duration, and therefore, piston 80 and plunger 90 will move at their quickened pace for a corresponding short time. However, if annulus 94 is relatively large, or tall, fuel pressurization chamber 98 will be open to spill passage 92 for a relatively long duration, causing piston 80 and plunger 90 to rapidly advance for a corresponding relatively long time. It should also be appreciated that other factors influence the length, and speed, at which piston 80 and plunger 90 advance during this portion of their movement. For instance, the diameter of spill passage 92 will also directly affect the movement of piston 80 and plunger 90 and the volume of fuel spilled. Therefore, if the diameter of spill passage 92 is relatively small, a smaller amount of fuel will be able to spill from fuel pressurization chamber 98, resulting in a smaller decrease in the pressure in the same. This will result in less of an increase in the rate of movement of piston 80 and plunger 90 toward their advanced positions due to this feature. However, if the diameter of spill passage 92 is relatively large, a greater amount of fuel will be able to spill from fuel pressurization chamber 98 causing a more dramatic decrease in the pressure within the same. Therefore, it should be appreciated that the diameter of spill passage 92 and the size of annulus 94 should be taken into consideration when constructing fuel injector 40 to achieve the desired front end rate shaping.

Returning now to fuel injector 40, a pressure relief valve 73 is movably positioned in injector body 41 to prevent pressure spikes and vent fluid pressure from actuation fluid cavity 78 and piston bore 87 toward the end of an injection event. Pressure spikes can be created when piston 80 and plunger 90 abruptly stop their downward movement due to the abrupt closure of nozzle outlet 110. Pressure spikes can sometimes cause an undesirable secondary injection due to an interaction of components and passageways over a brief instant after main injection has ended. Therefore, injector body 41 also defines a pressure relief passage 70 that opens to low pressure drain 27 via a low pressure passage 74. When control valve member 67 is in its downward position, such as during an injection event, a pin 72 holds pressure relief valve 73 downward to close pressure relief passage 70. At the end of an injection event, when ball valve member 58 opens high pressure seat 60, control valve member 67 moves away from its downward position due to the high pressure acting on hydraulic surface 68. At this time, residual high pressure acting on pressure relief valve 73 will open pressure relief passage 70 to drain 27. Movement of pressure relief valve 73 toward its upward position will also provide a boost to control valve member 67, to quicken movement of the same to its upward position. This is accomplished via contact of control valve member 67 and pressure relief valve 73 with pin 72.

Also included in fuel injector 40 is a direct control needle valve 100 that is positioned in injector body 41 and includes a needle valve member 101 that is movable between a first position, in which nozzle outlet 110 is open, and a downward second position in which nozzle outlet 110 is blocked. Needle valve member 101 is mechanically biased toward its downward closed position by a biasing spring 104. Needle valve member 101 includes opening hydraulic surfaces 108 that are exposed to fluid pressure within a nozzle chamber 105 and a closing hydraulic surface 102 that is exposed to fluid pressure within a needle control chamber 103. As illustrated in FIG. 2, closing hydraulic surface 102 is exposed to high pressure passage 65 when solenoid 52 is de-energized and pilot valve member 58 is positioned to close low pressure seat 61. Similarly, closing hydraulic surface 102 is exposed to low pressure passage 57 when solenoid 52 is energized and pilot valve member 58 is positioned to close high pressure seat 60.

Closing hydraulic surface 102 and opening hydraulic surfaces 108 are sized such that even when a valve opening pressure is attained in nozzle chamber 105, needle valve member 101 will not move against the action of biasing spring 104 when needle control chamber 103 is exposed to high pressure in needle control passage 63. In a similar manner, once solenoid 52 is de-energized at the end of an injection event, the high pressure in needle control chamber 103 will act to quickly move needle valve member 101 to close nozzle outlet 110 and end the injection event. Additionally, because closing hydraulic surface 102 has a larger effective area than opening hydraulic surfaces 108, once solenoid 52 is de-energized, the high pressure acting on closing hydraulic surface 102 will prevent needle valve member 101 from re-opening nozzle outlet 110 and injecting additional fuel into the combustion space. However, it should be appreciated that the relative sizes of closing hydraulic surface 102 and opening hydraulic surfaces 108 and the strength of biasing spring 104 should be such that when closing hydraulic surface 102 is exposed to low pressure in needle control passage 63, the high pressure acting on opening hydraulic surfaces 108 should be sufficient to move needle valve member 101 upward against the force of biasing spring 104 to open nozzle outlet 110.

INDUSTRIAL APPLICABILITY

Prior to the start of an injection event, low pressure in fuel pressurization chamber 98 prevails, piston 80 and plunger 90 are in their retracted positions, pilot valve member 58 is positioned to close low pressure seat 60 by the force of biasing spring 53 and high pressure fluid in high pressure actuation fluid supply passage 65, needle valve member 101 is in its biased position closing nozzle outlet 110, and actuation fluid cavity 78 is in fluid communication with low pressure passage 66. The injection event is initiated by activation of solenoid 52, which causes armature 53 to push pin 56 downward to move pilot valve member 58 to close high pressure seat 60.

When pilot valve member 58 closes high pressure seat 60, needle control passage 63 and spool control passage 64 become fluidly connected to low pressure passage 57 via control passage 59. This causes a dramatic drop in the pressure acting on control valve hydraulic surface 68 and closing hydraulic surface 102. The drop in pressure acting on control valve hydraulic surface 68 allows control valve 67 to move toward its downward position against the action of biasing spring 69. As control valve 67 returns to its downward position, actuation fluid cavity 78 becomes blocked from fluid communication with low pressure drain passage 66 and fluidly connected to high pressure supply passage 69 via radial openings 62. Piston 80 and plunger 90 begin to move toward their advanced positions as first hydraulic surface 81 is exposed to high pressure in actuation fluid cavity 78. Recall that second hydraulic surface 86 is also exposed to a fluid pressure via restricted side passage 76, but the pressure is preferably relatively low due to the flow restriction and the rate at which the fluid volume above surface 86 grows. This initial movement is relatively slow because less than the complete top surface of piston 80 is exposed to high pressure in actuation fluid cavity 78 at this time.

Recall that low pressure is acting on closing hydraulic surface 102 because needle control chamber 103 is fluidly connected to low pressure passage 57 via needle control passage 63. As piston 80 and plunger 90 begin to advance, fuel pressure within fuel pressurization chamber 98 increases. This results in an increase in fuel pressure within nozzle chamber 105 because needle valve member 101 is still in a downward position closing nozzle outlet 110. The increasing pressure of the fuel within nozzle chamber 105 acts on opening hydraulic surfaces 108 of needle valve member 101. When the pressure exerted on opening hydraulic surfaces 108 exceeds a valve opening pressure, needle valve member 101 is lifted against the action of biasing spring 104, and fuel is allowed to spray into the combustion chamber from nozzle outlet 110.

As the injection event continues, piston 80 and plunger 90 advance to allow annulus 94 to open fuel pressurization chamber 98 to spill passage 92. Note that in the fuel injector illustrated in FIGS. 2–3, fuel pressurization chamber 98 is opened to spill passage 92 just prior to first hydraulic surface 81 passing shoulder 83. The pressure within fuel pressurization chamber 98, which has been steadily increasing with the advancing movement of plunger 90, drops suddenly as fuel within fuel pressurization chamber 98 can flow into a low pressure area via internal passageways 96 and spill passage 92. A combination of the high pressure acting on the top of the pumping element in actuation fluid cavity 78 and the drop in pressure below the pumping element allows piston 80 and plunger 90 to move very rapidly toward their advanced positions.

It is during this period of rapid downward movement that first hydraulic surface 81 passes shoulder 83, and second hydraulic surface 86 becomes exposed to high pressure in actuation fluid cavity 78. After top hat portion 82 has completely moved past shoulder 83, annulus 94 moves past spill passage 92 to close fuel pressurization chamber 98 from the low pressure area. It should be appreciated that movement of piston 80 and plunger 90 toward their advanced position achieves its maximum speed as spill passage 92 is being closed from fuel pressurization chamber 98. The combination of exposure of both first hydraulic surface 81 and second hydraulic surface 86 to high pressure in actuation fluid cavity 78, in addition to the momentum of piston 80 and plunger 90 causes fuel injection pressure to peak.

Shortly before the desired amount of fuel has been injected into the combustion space, current to solenoid 52 is ended to end the injection event. Solenoid 52 is de-energized and pilot valve member 58 moves under the hydraulic force of high pressure actuation fluid in high pressure actuation fluid supply passage 65 to close low pressure seat 61 which in turn closes needle control passage 63 and spool control passage 64 from fluid communication with low pressure passage 57 and fluidly connects it to the high pressure manifold 47. High pressure within needle control chamber 103 then acts on closing hydraulic surface 102 and causes needle valve member 101 to move to its downward, closed position to close nozzle outlet 110. Control valve hydraulic surface 68 and closing hydraulic surface 102 are now exposed to high pressure actuation fluid via spool control passage 64 and needle control passage 63, respectively. Because high pressure is now acting on hydraulic surface 68, control valve 67 is once again hydraulically balanced and begins to move toward its upward position.

As control valve 67 moves toward its upward position, ball valve member 73 can move upward to open pressure relief passage 70 to low pressure drain 67. This allows high pressure actuation fluid in actuation fluid cavity 78 and piston bore 87 to be vented, thus preventing any secondary injection events. Additionally, upward movement of pressure relief valve 73 gives control valve 67 a boost toward its upward position. As control valve 67 continues to move upward, actuation fluid cavity 78 is fluidly connected to low pressure passage 66 while being blocked from fluid communication with high pressure passage 69.

Just prior to the opening of actuation fluid cavity 78 to low pressure passage 66, the downward descent of piston 80 and plunger 90 ends. Once actuation fluid cavity 78 is open to low pressure passage 66, first hydraulic surface 81 and second hydraulic surface 86 are exposed to low pressure in actuation fluid cavity 78 and piston 80 and plunger 90 begin to move toward their upward, biased positions under the action of biasing spring 88. This upward movement of plunger 90 relieves the pressure of fuel within fuel pressurization chamber 98 and causes a corresponding drop in pressure in nozzle supply passage 106 and nozzle chamber 105. In addition, the retracting movement of plunger 90 causes fuel from fuel inlet 30 to be pulled into fuel pressurization chamber 98 via fuel supply passage 34.

Figure 4:
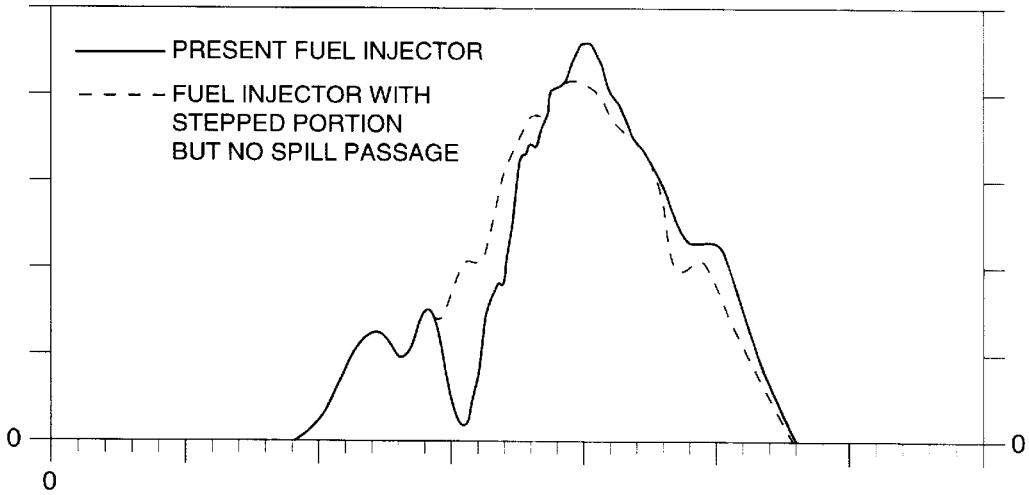
FIG. 4 is a graph of injection pressure versus time for the FIG. 3 embodiment of the present invention.
Figure 5:
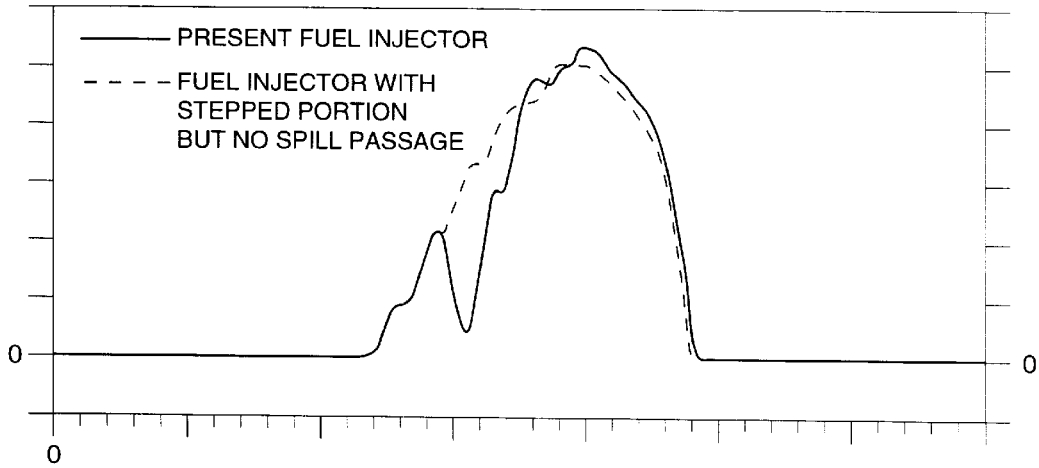
FIG. 5 is a graph of injection rate versus time for the FIG. 3 embodiment of the present invention.

Referring now to FIGS. 4 and 5, injection pressure and injection rate have been graphed versus time for fuel injector 40 at a single operating condition, which in this case corresponds to a rated condition and high rail pressure. In addition, injection pressure and injection rate for a fuel injector having a stepped portion but no spill passage has been included on the FIGS. 4 and 5 graphs for comparison. At the beginning of an injection event, the fuel injector of the present invention and the comparison fuel injector perform virtually the same. Because piston 80 and plunger 90 are moving at a reduced speed, injection pressure is low but steadily increasing during this initial period, as seen in FIG. 4. This corresponds to a slow ramp injection at the beginning of the injection event, as shown in FIG. 5.

Once annulus 94 opens fuel pressurization chamber 98 to spill passage 92, the injection characteristics of the present invention begin to differ from those of the comparison fuel injector. The sudden drop in pressure within fuel pressurization chamber 98 of the present invention results in a drop in injection pressure that can be seen in FIG. 4. This sudden drop in injection pressure corresponds to a sudden drop in injection rate, as shown in FIG. 5. Note that injection pressure for the comparison fuel injector, which does not have a spill passage, begins to level off as piston 80 and plunger 90 continue to advance. Similarly, injection rate for the comparison injector begins to level off.

Referring again to the fuel injector of the present invention, once fuel pressurization chamber 98 is closed to spill passage 92, and second hydraulic surface is fully exposed to high pressure actuation fluid in actuation fluid cavity 78, injection pressure begins to increase once again. As shown in FIG. 4, a dramatic increase in injection pressure occurs because of the high velocity of piston 80 and plunger 90. As FIG. 4 illustrates, the added momentum of piston 80 and plunger 90, which resulted from the lower pressure in fuel pressurization chamber 98 when it was open to spill passage 92, will allow injector 40 to achieve a higher peak injection pressure than that of the comparison fuel injector. This is due to the of build-up of momentum of piston 80 and plunger 90 when fuel pressurization chamber 98 is open to the low pressure area combined with exposure of both first hydraulic surface 81 and second hydraulic surface 86 to high pressure in actuation fluid cavity 78. Finally, the injection rate for the fuel injector of the present invention steadily increases once again until it reaches its peak for the injection event, as shown in FIG. 5.

The present invention utilizes both a spill passage that can open the fuel pressurization chamber to a low pressure area and a piston having a stepped portion to change the front end rate shape for an injection event. However, it should be appreciated that each of these elements results in a different phenomenon during the injection event. For instance, referring now to stepped portion 82, first hydraulic surface 81 and second hydraulic surface 86, it should be appreciated that changes in the structure and orientation of these features will alter the manner in which the stepped portion of the piston effects the injection event. It should be further appreciated that different rail pressures will change the manner in which this feature of the present invention affects injection pressure. For a given rail pressure, the greater the surface area of first hydraulic surface 81, the greater the initial speed of piston 80 and plunger 90 toward their advanced positions. For the range of rail pressures over which fuel injector 40 operates, surface area of first hydraulic surface 81 should be large enough that piston 80 can move toward its advanced position to allow an injection event to begin when only first hydraulic surface 81 is exposed to fluid pressure in actuation fluid cavity 78. However, first hydraulic surface 81 should have a small enough surface area that the desired injection pressure and rate shape is achieved at the beginning of the injection event. With respect to the other extreme, it should be appreciated that the surface area of first hydraulic surface 81 could be so large that stepped portion 82 would have no measurable effect on the injection event for a given rail pressure within the injectors operating range.

It should also be appreciated that the shape of first hydraulic surface 81 and second hydraulic surface 86 will also have an effect on injection rate shape and injection pressure for an injection event. For instance, if fuel injector 40 did not include spill passage 92, the present invention would yield either a ramp-square or a boot shaped injection rate trace. At the start of the injection event, when piston 80 and plunger 90 are beginning to advance, the injection rate would increase steadily. However, once an equilibrium is achieved between the hydraulic force acting on the top of piston 80 and on plunger hydraulic surface 97, injection rate would level off. Injection rate would remain steady until second hydraulic surface 86 became exposed to fluid pressure in actuation fluid cavity 78. At that time, injection rate would again increase with the increased speed of piston 80 and plunger 90 due to exposure of a greater surface area on top of piston 80 to high pressure. As the speed of piston 80 and plunger 90 again neared a constant rate, so would the injection pressure, and therefore injection rate, for the remainder of an injection event. However, it should be appreciated that other rate shapes could be possible if first hydraulic surface 81 and second hydraulic surface 86 have different geometries. For instance, addition of an annular taper to first hydraulic surface 81 would result in a steady increase in injection pressure, and therefore injection rate, until second hydraulic surface 86 was fully exposed to fluid pressure within actuation fluid cavity 78 because piston 80 would be experiencing a steady increase in speed until hydraulic surface 86 was fully exposed to fluid pressure.

Figure 6:
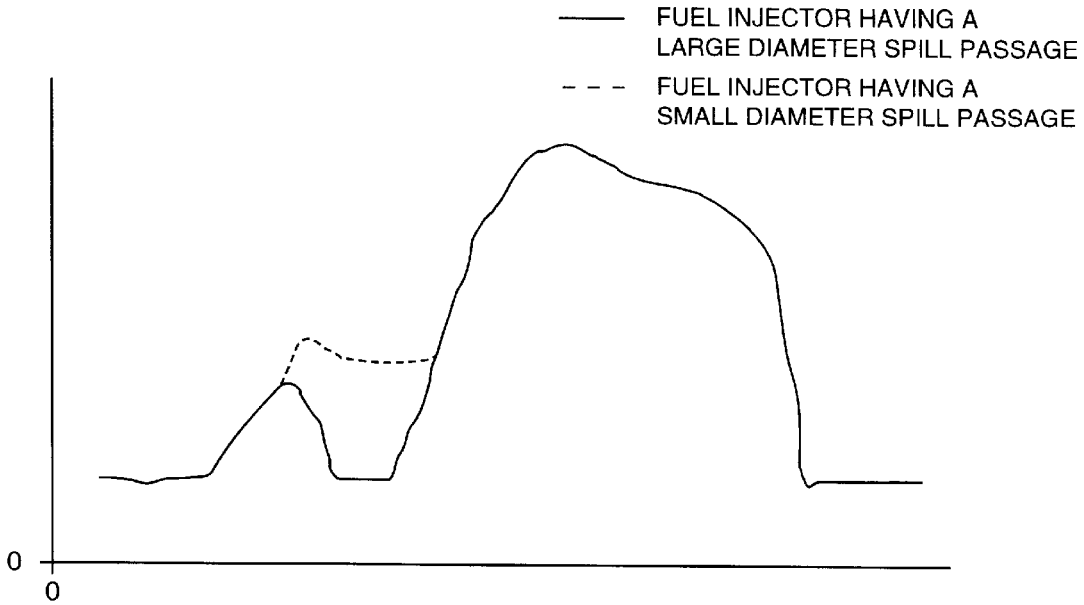
FIG. 6 is a graph of injection rate versus time for a fuel injector having a relatively small diameter spill passage and a fuel injector having a relatively large diameter spill passage.

Returning now to fuel injector 40, it should be appreciated that opening fuel pressurization chamber 98 to a low pressure area via spill passage 92 has a different effect on injection pressure and injection rate shape than the previous element of the present invention. For instance, the smaller the diameter of spill passage 92, the smaller the decrease in the pressure within fuel pressurization chamber 98. Referring now to FIG. 6, this corresponds to a relatively small reduction in injection rate trace while spill passage 92 is open to fuel pressurization chamber 98. However, if the diameter of spill passage 92 is relatively large, pressure within fuel pressurization chamber 98 will experience a more dramatic reduction. This will correspond to a greater reduction in injection rate, and can even result in a split injection if the diameter of spill passage 92 is large enough, or if rail pressure is low enough.

Figure 7:
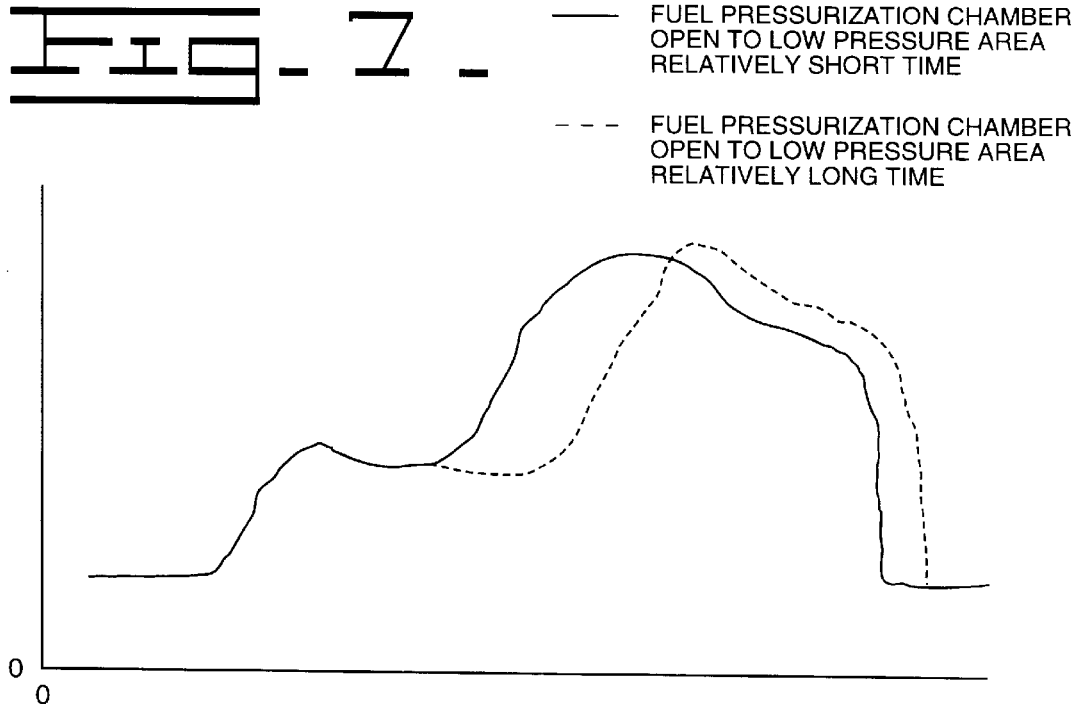
FIG. 7 is a graph of injection rate versus time for a fuel injector having a fuel pressurization chamber open to the low pressure area for a relatively long duration and a fuel injector having a fuel pressurization chamber open to the low pressure area for a relatively short duration.

Additionally, the longer that fuel pressurization chamber 98 is open to the low pressure area, the greater the build-up of momentum of piston 80 and plunger 90. This will result in a higher peak injection pressure for the injection event. Referring now to FIG. 7, injection rate has been shown versus time for a fuel injector having fuel pressurization chamber 98 open to the low pressure area for both a relatively short period of time and a relatively long period of time. Note that when fuel pressurization chamber 98 is open to the low pressure area for a relatively short period of time, the boot portion of the injection event is shorter. However, if fuel pressurization chamber 98 is open to the low pressure area for a relatively long period of time, the boot portion of the injection event is longer, and the injection rate could level off. The length of time that fuel pressurization chamber 98 is open to the low pressure area is dependent upon not only the height of annulus 94, but also the rail pressure for the injection event. Therefore, if the rail pressure for the injection event is relatively high, fuel pressurization chamber 98 will be open to the low pressure area a relatively short amount of time. This is because of the relatively high fluid pressure acting on the top surface of piston 80. However, if the rail pressure for the injection event is relatively low, fuel pressurization chamber 98 will be open to the low pressure area a relatively long amount of time due to the lower pressure acting on the top surface of piston 80.

Figure 8:
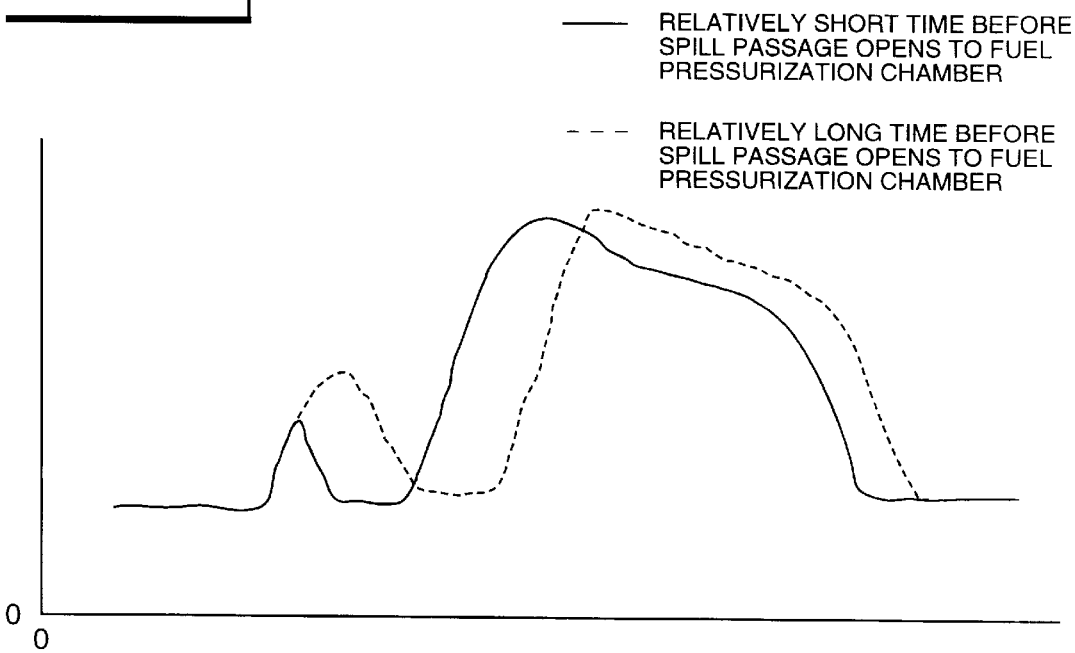
FIG. 8 is a graph of injection rate versus time for a fuel injector having a spill passage that opens to the fuel pressurization chamber relatively early in the injection event and a fuel injector having a spill passage that opens to the fuel pressurization chamber later in the injection event.

In addition to those properties of spill passage 92 that are discussed above, the length of time before spill passage 92 is open to fuel pressurization chamber 98 can also influence the injection rate trace for an injection event. Referring now to FIG. 8, injection rate has been graphed versus time for a fuel injector having a relatively long time before spill passage 92 is open to fuel pressurization chamber 98 and a relatively short time before spill passage 92 is open to fuel pressurization chamber 98. Note that when spill passage 92 opens fuel pressurization chamber 98 to the low pressure area later in the injection event, injection rate will peak at a higher amount than when spill passage 92 is opened to fuel pressurization chamber 98 at an earlier point in the injection event. This should correspond to a higher peak injection pressure in fuel injectors having a relatively long time during the injection event before spill passage 92 is opened to fuel pressurization chamber 98 than for those when spill passage 92 opens to fuel pressurization chamber 98 earlier in the injection event.

In addition to stepped portion 82 and spill passage 92, injection pressure and rate for fuel injector 40 are also influenced by direct control needle valve 100. Recall that movement of needle valve member 101 is directly influenced by fuel pressure in fuel pressurization chamber 98. Therefore, effects on fuel pressure in fuel pressurization chamber 98 from spill passage 92 and rail pressure influence the movement of needle valve member 101. For instance, when rail pressure is relatively low, it is possible to create split injections with spill passage 92. If fuel injector 40 is operating at idle operating conditions, piston 80 and plunger 90 advance more slowly at the beginning of an injection event due to the lower pressure acting on first hydraulic surface 83. This will result in a lower injection pressure having been reached when spill passage 92 is opened to fuel pressurization chamber 98, than would be reached at a rated operating condition. Therefore, if injection pressure is low enough, the drop in pressure created by opening fuel pressurization chamber 98 to spill passage 92 could result in the pressure acting on opening hydraulic surface 108 dropping below the valve closing pressure, thus allowing needle valve member 101 to briefly close. Once stepped portion 82 moves past shoulder 83 and spill passage 92 is closed to fuel pressurization chamber 98, pressure acting on opening hydraulic surface 108 will once again surpass a valve opening pressure, and needle valve member 101 will reopen for the second part of the split injection. It should be appreciated that split injections are also possible at rated operating conditions with the present invention, however, size of stepped portion 82 and annulus 94 must be sufficiently small that pressure acting on opening hydraulic surface 108 will fall below valve closing pressure when spill passage 92 is opened to fuel pressurization chamber 98.

Figure 9:
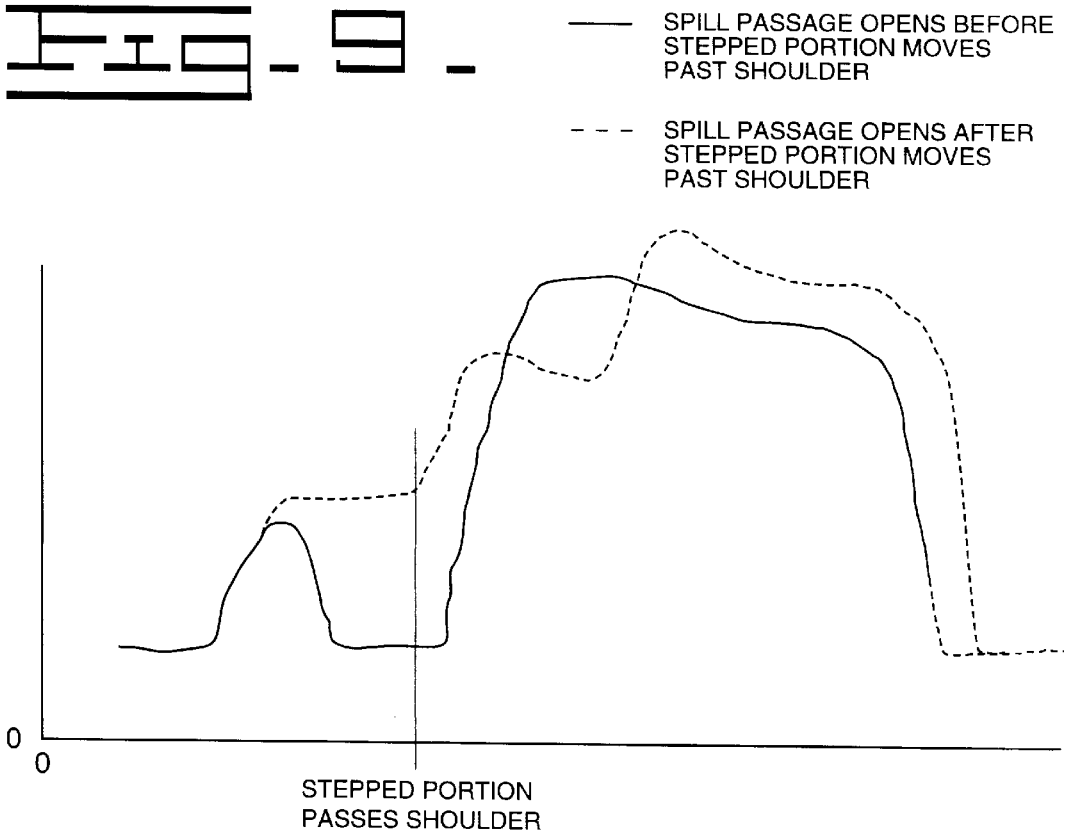
FIG. 9 is a graph of injection rate versus time for a fuel injector having a spill passage that opens to the fuel pressurization chamber after the stepped portion of the piston moves past the shoulder and a fuel injector having a spill passage that opens to the fuel pressurization chamber before the stepped portion of the piston moves past the shoulder.

It should be appreciated that a number of modifications could be made to piston 80, plunger 90 and injector body 41 without departing from the spirit of the present invention. For instance, while the present invention has been shown and described for a fuel injector having a spill passage 92 that is open to the fuel pressurization chamber 98 only prior to second hydraulic surface 86 of piston 80 being exposed to fluid pressure in actuation fluid cavity 78, it should be appreciated that other alternatives are possible. Fuel injector 40 could be modified such that spill passage 92 is opened to fuel pressurization chamber 98 prior to second hydraulic surface 86 being exposed to fluid pressure in actuation fluid cavity 78 and closed to fuel pressurization chamber 98 before stepped portion 82 moves past shoulder 83. Conversely, fuel injector 40 could be modified such that spill passage 92 is not opened to fuel pressurization chamber 98 until after second hydraulic surface 86 is opened to actuation fluid cavity 78. Referring now to FIG. 9, injection rate trace has been graphed versus time for the present fuel injector and a fuel injector having a spill passage that does not open until after the second hydraulic surface is opened to the actuation fluid cavity. Note that for fuel injectors having a spill passage that opens after the entire top surface of the piston is exposed to fluid pressure in the actuation fluid cavity, an injection rate trace having multiple boot portions can be created. In other words, injection rate will initially increase and then level off prior to the second hydraulic surface being exposed to fluid pressure in the actuation fluid cavity. At that point, injection rate will increase until the spill passage is opened to the fuel pressurization chamber. This will result in a decrease in injection rate corresponding to the length of time-that the spill passage is open to the fuel pressurization chamber. Finally, when the spill passage is closed to the fuel pressurization chamber, injection rate will increase until it peaks for the injection event.

Additionally, while piston 80 has been illustrated having a single stepped portion, it could instead include additional stepped portions. Further, fuel injector 40 could be modified by altering the location of the annulus 94, such that the fuel pressurization chamber opened to the spill passage over a different portion of the movement of the piston and the plunger. Finally, recall that the diameter of the spill passage could be altered to affect the drop in fuel pressure within the fuel pressurization chamber. In other words, an increase in the diameter of the spill passage will result in a greater drop in pressure in the fuel pressurization chamber, while a decrease in the diameter of the spill passage will result in a reduced drop in pressure in the fuel pressurization chamber.

The present invention finds application in any hydraulically actuated fuel injector for which front end rate shaping is desired. By modifying a conventional pumping element to include a piston having one or more stepped portions and/or a plunger that defines at least one passageway that can connect the fuel pressurization chamber to a spill passage, engineers have a greater flexibility in injection rate shapes. This flexibility is increased further by the addition of a direct control needle valve. This in turn will allow engineers to create a number of different front end rate shapes that were previously not possible. For instance, while the stepped portion of the fuel injector of the present invention has only been shown producing a ramp shape injection, it can also be used to produce a boot shaped injection as well. Once engineers have the ability to manipulate all aspects of injection rate profiles, including the front end rate shaping described herein, they will have a greater ability to decrease undesirable emissions and to increase injector performance.

It should be understood that the above description is intended for illustrative purposes only, and is not intended to limit the scope of the present invention in any way. For instance, while only one spill passage has been illustrated as defined by the injector body, it should be appreciated that two or more spill passages could be included that open the fuel pressurization chamber to a low pressure area at different times during the movement of the pumping element. Further, while the present invention has been illustrated as opening the spill passage to the fuel pressurization chamber prior to the second hydraulic surface being exposed to fluid pressure in the actuation fluid cavity and closing the fuel pressurization chamber to the low pressure area after the second hydraulic surface is exposed to fluid pressure in the actuation fluid cavity, this need not be the case. In other words, the various portions of the pumping element could be sized and positioned such that the fuel pressurization chamber is opened to the low pressure area by the spill passage and then closed to the low pressure area prior to the second hydraulic surface being exposed to fluid pressure in the actuation fluid cavity. Thus, those skilled in the art will appreciate that various modifications could be made to the disclosed embodiments without departing from the intended scope of the present invention, which is defined in terms of the claims set forth below.

What is claimed is:

1. A hydraulically actuated fuel injection system comprising:

at least one hydraulically actuated fuel injector including an injector body defining a fuel pressurization chamber;

a pumping element having a stepped top being movably mounted in a pumping bore defined by said injector body and defining at least one internal passageway, and said stepped top including a first hydraulic surface and a second hydraulic surface;

said pumping element being movable a distance between a first position and a second position;

said first hydraulic surface being exposed to fluid pressure in a first cavity, and said second hydraulic surface being exposed to fluid pressure in a second cavity when said pumping element is in said first position; and a spill passage defined by said injector body being open to said fuel pressurization chamber via said at least one internal passageway over a portion of said distance.

2. The hydraulically actuated fuel injection system of claim 1 wherein said first cavity is fluidly connected to a restricted passage, and said second cavity is an unrestricted actuation fluid cavity; and said spill passage is open to said at least one internal passageway when said first hydraulic surface is exposed to high pressure in said actuation fluid cavity.

3. The hydraulically actuated fuel injection system of claim 1 wherein said pumping element further defines an annulus that opens said spill passage to said at least one internal passageway.

4. The hydraulically actuated fuel injection system of claim 1 wherein said injector body defines an actuation fluid inlet fluidly connected to a source of high pressure actuation fluid and an actuation fluid outlet fluidly connected to a low pressure actuation fluid reservoir; and said injector body defines a fuel inlet fluidly connected to a source of medium pressure fuel.

5. The hydraulically actuated fuel injection system of claim 1 wherein said at least one fuel injector further includes a needle control passage and a nozzle supply passage defined by said injector body;

a direct control needle valve member is movably positioned within said at least one fuel injector and includes a closing hydraulic surface exposed to fluid pressure in said needle control passage and an opening hydraulic surface exposed to fluid pressure in said nozzle supply passage; and said needle control passage is alternately connectable to one of a high pressure source and a low pressure source.

6. The hydraulically actuated fuel injection system of claim 1 wherein said at least one internal passageway fluidly connects said fuel pressurization chamber to a low pressure area when said at least one internal passageway is open to said spill passage.

7. The hydraulically actuated fuel injection system of claim 1 wherein said pumping element includes a plunger coupled to a piston having said stepped top.

8. A hydraulically actuated fuel injector comprising:

an injector body;

a pumping element having a stepped top being positioned in a pumping bore defined by said injector body and defining at least one internal passageway, said pumping element being moveable a distance between a first position and a second position;

said at least one internal passageway opening into a fuel pressurization chamber defined by at least one of said injector body and said pumping element;

a first hydraulic surface of said stepped top being exposed to fluid pressure in a first cavity, and a second hydraulic surface being exposed to fluid pressure in a second cavity when said pumping element is in said first position; and a spill passage being defined by said injector body and being open to said at least one internal passageway over a portion of said distance.

9. The hydraulically actuated fuel injector of claim 8 wherein said at least one internal passageway fluidly connects said fuel pressurization chamber to a low pressure area when said at least one internal passageway is open to said spill passage.

10. The hydraulically actuated fuel injector of claim 8 wherein said pumping element further defines an annulus that opens said spill passage to said at least one internal passageway.

11. The hydraulically actuated fuel injector of claim 8 wherein said first cavity is fluidly connected to a restricted passage, and said second cavity is an unrestricted actuation fluid cavity; and said spill passage is open to said at least one internal passageway when said first hydraulic surface is exposed to high pressure in said actuation fluid cavity.

12. The hydraulically actuated fuel injector of claim 8 wherein said injector body defines a needle control passage and a nozzle supply passage;

a direct control needle valve remember is movably positioned within said fuel injector and includes a closing hydraulic surface exposed to fluid pressure in said needle control passage and an opening hydraulic surface exposed to fluid pressure in said nozzle supply passage; and said needle control passage is alternately connectable to one of a high pressure source and a low pressure source.

13. The hydraulically actuated fuel injector of claim 8 wherein said injector body further defines a nozzle outlet;

a direct control needle valve member is positioned in said fuel injector and is movable between a first position in which said nozzle outlet is open to said fuel pressurization chamber and a second position in which said nozzle outlet is closed from said fuel pressurization chamber; and said needle control passage is alternately connectable to one of a high pressure source and a low pressure source.

14. The hydraulically actuated fuel injector of claim 8 wherein said pumping element includes a piston having said stepped top coupled to a plunger.

15. The hydraulically actuated fuel injector of claim 8 wherein said injector body defines an actuation fluid inlet fluidly connected to a source of high pressure actuation fluid and an actuation fluid outlet fluidly connected to a low pressure actuation fluid reservoir; and said injector body defines a fuel inlet fluidly connected to a source of medium pressure fuel.

16. A hydraulically actuated fuel injector comprising:

an injector body defining a needle control passage and a nozzle supply passage;

a pumping element having a stepped top being positioned in a pumping bore defined by said injector body and defining at least one internal passageway, said pumping element being moveable a distance between a first position and a second position;

said at least one internal passageway opening into a fuel pressurization chamber defined in part by said injector body and said pumping element;

a spill passage being defined by said injector body and being open to a fuel pressurization chamber via said at least one internal passageway over a portion of said distance;

a first hydraulic surface of said stepped top being exposed to fluid pressure in a first cavity, and a second hydraulic surface being exposed to fluid pressure in a second cavity when said pumping element is in said first position; and a direct control needle valve member including a closing hydraulic surface exposed to fluid pressure in said needle control passage and an opening hydraulic surface exposed to fluid pressure in said nozzle supply passage; and said needle control passage is alternately connectable to one of a high pressure source and a low pressure source.

17. The hydraulically actuated fuel injector of claim 16 said at least one internal passageway fluidly connects said fuel pressurization chamber to a low pressure area when said at least one internal passageway is open to said spill passage.

18. The hydraulically actuated fuel injector of claim 17 wherein said injector body defines an actuation fluid inlet fluidly connected to a source of high pressure actuation fluid and an actuation fluid outlet fluidly connected to a low pressure actuation fluid reservoir; and said injector body defines a fuel inlet fluidly connected to a source of medium pressure fuel.

19. The hydraulically actuated fuel injector of claim 18 wherein said pumping element includes a piston having said stepped top coupled to a plunger.

20. The hydraulically actuated fuel injector of claim 19 wherein said spill passage is open to said at least one internal passageway when one of said first hydraulic surface and said second hydraulic surface is exposed to high pressure in said actuation fluid cavity.

* * * * *